US006678978B2

(12) United States Patent
Maier-Hunke

(10) Patent No.: US 6,678,978 B2
(45) Date of Patent: Jan. 20, 2004

(54) DEVICE FOR HOLDING TURNING PLATES OR THE LIKE

(75) Inventor: Horst-Werner Maier-Hunke, Iserlohn (DE)

(73) Assignee: "Durable" Hunke & Jochheim GmbH & Co. KG, Iserlohn (DE)

( * ) Notice: Subject to any disclaimer, the term of this patent is extended or adjusted under 35 U.S.C. 154(b) by 0 days.

(21) Appl. No.: 10/221,234

(22) PCT Filed: Mar. 10, 2001

(86) PCT No.: PCT/DE01/00978

§ 371 (c)(1),
(2), (4) Date: Sep. 10, 2002

(87) PCT Pub. No.: WO01/69579

PCT Pub. Date: Sep. 20, 2001

(65) Prior Publication Data

US 2003/0037471 A1 Feb. 27, 2003

(30) Foreign Application Priority Data

Mar. 14, 2000 (DE) ..... 100 13 620

(51) Int. Cl.[7] ..... G09F 7/00

(52) U.S. Cl. ..... 40/376; 40/388; 40/402; 40/605; 40/492; 40/400

(58) Field of Search ..... 40/371, 373, 376, 40/388, 391, 394, 398, 400, 402, 403, 605, 492

(56) References Cited

U.S. PATENT DOCUMENTS

| | | | | | |
|---|---|---|---|---|---|
| 1,034,647 | A | * | 8/1912 | Rand | 40/400 |
| 1,272,094 | A | * | 7/1918 | Rand | 40/400 |
| 1,637,535 | A | * | 8/1927 | Rand | 40/391 |
| 1,866,089 | A | * | 7/1932 | Day | 40/398 |
| 2,095,662 | A | * | 10/1937 | Farrar | 40/400 |
| 2,265,597 | A | * | 12/1941 | Finch | 40/400 |
| 2,617,219 | A | * | 11/1952 | Conley et al. | 40/400 |
| 2,959,877 | A | * | 11/1960 | Deinlein | 40/400 |
| 3,302,318 | A | * | 2/1967 | Lewis | 40/403 |
| 3,782,013 | A | | 1/1974 | Hutchison | |
| 5,833,082 | A | * | 11/1998 | Barthel | 40/376 |

FOREIGN PATENT DOCUMENTS

| | | |
|---|---|---|
| DE | 1272883 | 7/1968 |
| DE | 3206695 | 9/1983 |
| DE | 19703754 | 8/1998 |

* cited by examiner

*Primary Examiner*—Gary Hoge
(74) *Attorney, Agent, or Firm*—Mark P. Stone

(57) ABSTRACT

The aim of the invention is to be able to vary a device for holding turning plates (14), turning pockets, turning sleeves or the like with regard to the receiving capacity thereof. The inventive turning plates, pockets, sleeves or the like are provided with pivoting pins (13). Carriers (1) can be connected to one another by means of coupling elements (5) which are provided with holes (26) that form lines of holes, whereby said carriers are used for the turning plates (14), turning pockets, turning sleeves or the like and are provided with holes (12) on the upper and lower edges thereof, whereby said holes form lines of holes. The pivoting pins (13) can be used for connecting the coupling elements (5) to the carriers (1) by selecting a common hole pitch (t) for the holes (12, 26) of the two lines of holes

19 Claims, 2 Drawing Sheets

DEVICE FOR HOLDING TURNING PLATES OR THE LIKE

TECHNICAL FIELD

The invention relates to a device for securing turnable panels, turnable pockets, turnable casings or the like which are provided, on a border in each case, with two oppositely directed, aligned pivot pins, in the case of which device aligned holes which form rows of holes, and are intended for accommodating the pivot pins, are provided on the top and bottom borders of a carrier.

PRIOR ART

A device of the abovementioned type is known from DE-B 1 272 883. The known device comprises two posts, which are connected by a top and bottom transverse carrier, and two side parts, which are fastened at the bottom ends of the posts by rivets and retain the posts in an upright position. The transverse carriers are provided with guide grooves and latching means for accommodating pivot pins which project, at the top and bottom ends in each case of a longitudinal border of the turnable panels, beyond the transverse borders of the latter. The construction of the abovedescribed device is comparatively complicated and it is consequently cost-intensive to produce.

Another known retaining device, which comprises an angled sheet-metal plate of which the legs form an angle of less than 90° (DURABLE, Catalog 950, p. 109), can be produced more cost-effectively. The shorter of the two legs forms a foot, while the longer leg is provided, at its top and bottom ends, with fittings which have pivot bearings for the turnable panels. In this case, the pivot bearings are formed by pins which engage in cylindrical mounts at the top and bottom ends in each case of a longitudinal border of the pivoting panels. The width of the sheet-metal plate and of the fittings depends on the number of turnable panels which are to be accommodated in each case.

While, in both the cases mentioned above, the number of turnable panels which are to be accommodated is determined by the width of the respective device, DE 197 03 754 C2 discloses a device which is constructed in the manner of a module system and allows the accommodating capacity of the device to be changed by virtue of components being coupled. The components of this third known device are designed largely as plastic injection moldings, the production of which is associated with comparatively high tool costs.

DESCRIPTION OF THE INVENTION

The object of the invention is to provide a device of the initially mentioned type which can be produced at low cost and, by straightforward means, allows its accommodating capacity to be changed. This object is achieved according to the invention in that, in the case of a device of the generic type in question, the carrier can be connected to at least one further carrier by coupling elements, in that the coupling elements have holes which form rows of holes and of which the hole spacing is coordinated with the hole spacing of the holes of the rows of holes of the carriers, and in that, for connecting adjacent carriers in each case, holes which belong to the coupling elements and are brought into an aligned position with holes of the carriers, on both sides of the connecting location, form common mounts for in each case one pivot pin.

The device according to the invention allows cost-effective production by the use of punching methods. The connection of a plurality of carriers to form a unit is particularly cleverly achieved insofar as the pivot pins of the turnable panels, turnable pockets, turnable casings or the like, in addition to their main function, perform an additional function by arresting the coupling elements in the coupling state.

BRIEF DESCRIPTION OF THE DRAWINGS

Further features and details of the invention can be gathered from the subclaims and from the following description of a particularly advantageous embodiment of the invention which is illustrated in the attached drawings, in which:

METHODS OF IMPLEMENTING THE INVENTION

Figure 1:
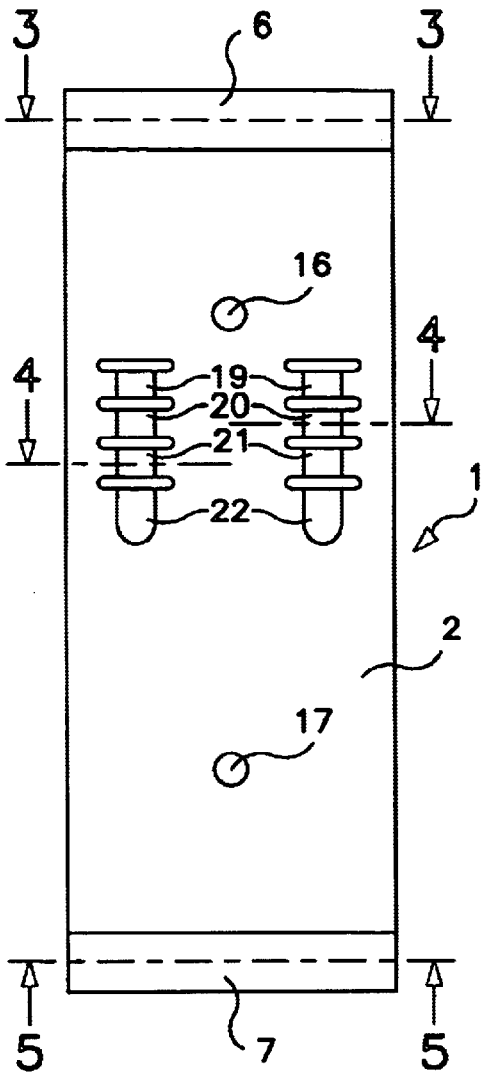
FIG. 1 shows the front view of an individual carrier of the device.
Figure 2:
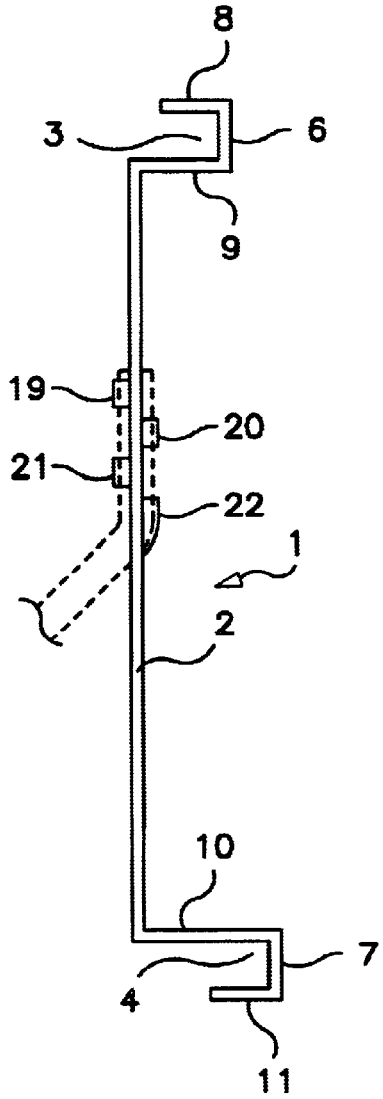
FIG. 2 shows the side view of the device according to FIG. 1.
Figure 3:
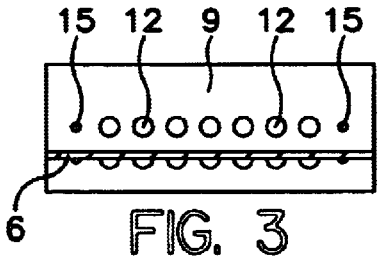
FIG. 3 shows a section along line III—III in FIG. 1.
Figure 4:
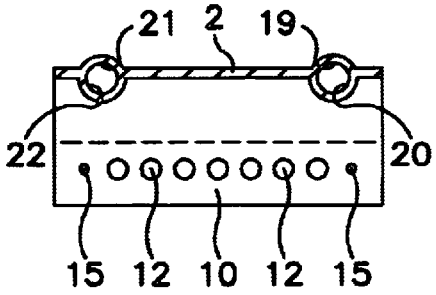
FIG. 4 shows a section along line IV—IV in FIG. 1.
Figure 5:
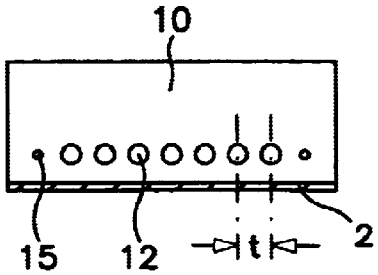
FIG. 5 shows a section along line V—V in FIG. 1.

In FIG. 1, 1 is a carrier which is punched from a sheet-metal plate and has a central part 2 with an essentially U-shaped guide channel 3 located on its top border and a likewise essentially U-shaped guide channel 4 located on its bottom border. The two guide channels 3 and 4, which are open in the direction of the rear side of the carrier 1, are formed from L-shaped protrusions of the central part 2 and serve for accommodating coupling elements 5 of the type illustrated in FIG. 7. The protrusions each comprise two legs 8, 9 and 10, 11, which are connected to one another via a respective yoke 6 or 7. The mutually facing legs 9, 10 of the protrusions are provided with holes 12 which form rows of holes, and are intended for accommodating pivot pins 13 of turnable panels 14 (see FIG. 8), and with latching holes 15, the latter serving for adjusting the coupling elements 5 when carriers 1 are joined together. Two additional holes 16, 17 can be utilized if it is desired for the carriers 1 to be wall-mounted. The carriers 1 are normally set up on a horizontal surface with the aid of supports 18 formed from a wire section (see FIGS. 6 and 8), use being made, for the purpose of fastening the supports 18, of hollows 19, 20, 21 and 22, which are open alternately toward the front and rear sides of the central part and, as can be seen from FIGS. 2, 6 and 8, retain the ends of the supports 18, which comprise wire brackets.

The coupling elements 5, like the guide channels 3 and 4, are of essentially U-shaped design, their outer dimensions being coordinated with the inner dimensions of the guide channels 3 and 4 such that they are retained in the guide channels 3 and 4 by way of clamping forces which are easy to overcome. Each coupling element 5 has two legs 24 and 25, which are connected to one another via a yoke 23 and the distance between which is greater than the length of the pivot pins 13. The legs 24 are provided with holes 26, which form rows of holes of the same spacing t as the rows of holes formed by the holes 12. Also located in the vicinity of the center of the coupling elements 5 are two virtually punctiform latching protuberances 27, the distance between which corresponds to the distance between the latching holes 15 of two carriers 1 arranged one beside the other, with the result that, when the coupling elements 5 are introduced into the guide channels 3, 4 of adjacent carriers 1, the latching protuberances 27 latch resiliently into the latching holes 15.

Figure 6:
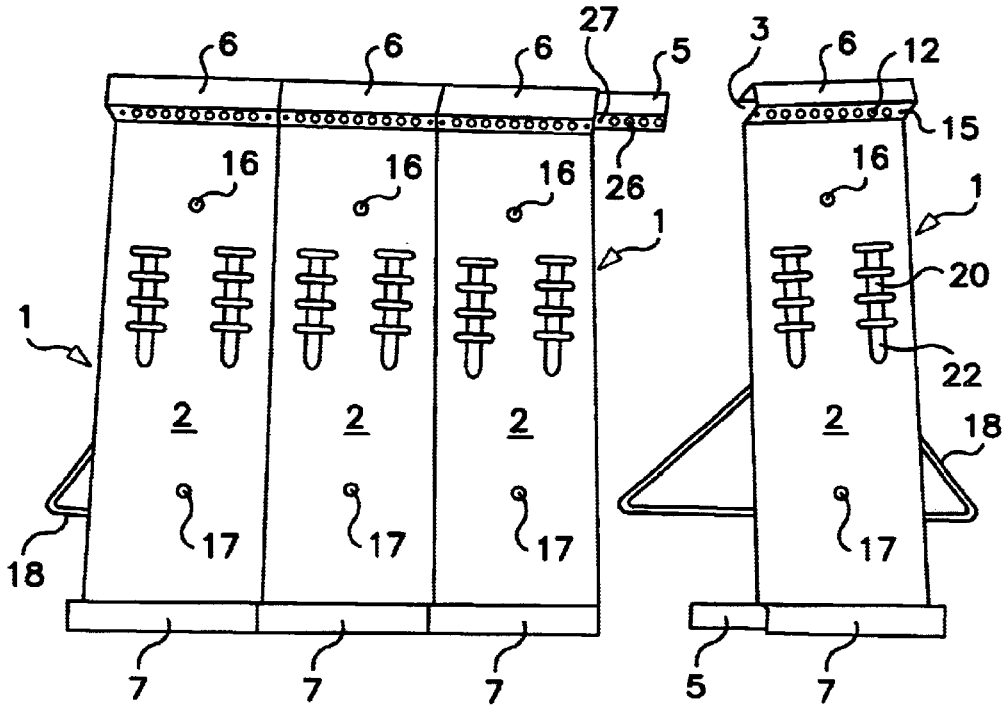
FIG. 6 shows the front view of four carriers which serve to form a unit.
Figure 7:
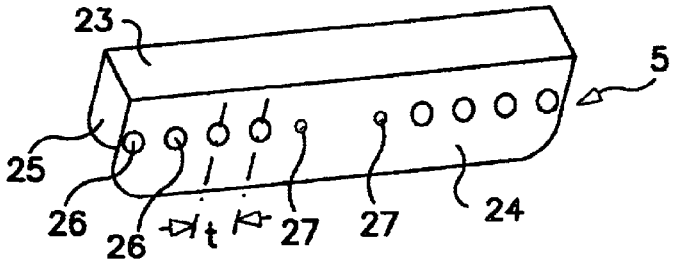
FIG. 7 shows the perspective view of a coupling element.
Figure 8:
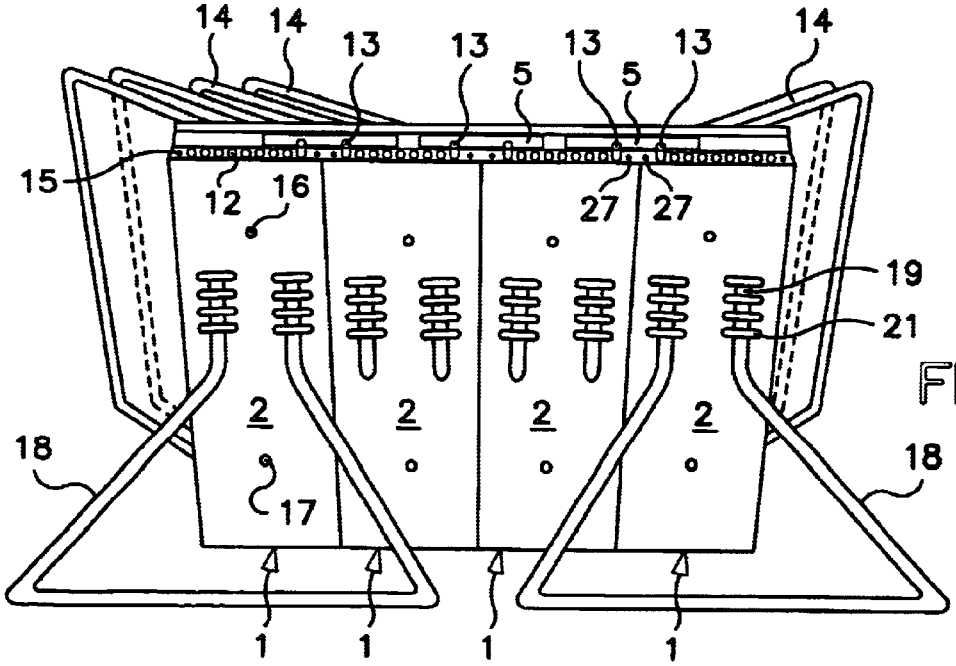
FIG. 8 shows the rear view of a device which comprises four carriers and has turnable panels fitted into the carriers in order to secure the coupling elements in the coupling position.

In the case of the unit which is illustrated in FIGS. 6 and 8, and is formed from four carriers 1, the supports 18 are connected to the two outer carriers 1. If, in contrast, only two carriers 1 are coupled to one another, then one end of the support 18 will be connected to one carrier 1 and the other end of the support 18 will be connected to the other carrier 1.

What is claimed is:

1. A device for securing turnable elements which are provided, on a border in each case, with two oppositely directed, aligned pivot pins, in the case of which device aligned holes which form rows of holes, and are intended for accommodating the pivot pins, are provided on the top and bottom borders of a carrier, characterized in that the carrier (1) can be connected to at least one further carrier by coupling elements (5), in that coupling elements (5) have holes (26) which form rows of holes and of which the hole spacing (t) is coordinated with the hole spacing (t) of the holes (12) of the rows of holes of the carriers (1), and in that, for connecting adjacent carriers (1, 1) in each case, holes (26) which belong to the coupling elements (5) and are brought into an aligned position with holes (12) of the carriers (1), on both sides of the connecting location, form common mounts for in each case one pivot pin (13).

2. The device as claimed in claim 1, characterized in that the coupling elements (5), on both sides of their center, have at least in each case two holes (26) for accommodating in each case two pivot pins (13).

3. The device as claimed in claim 1, characterized in that the coupling elements (5) each have two legs (24, 25), which are connected to one another via a yoke (23) and of which one is provided with holes (26), and in that the distance between the legs (24, 25) is greater than the length of the pivot pins (13).

4. The device as claimed in claim 3, characterized in that the legs (24, 25) are connected to one another via a rectilinear yoke (26).

5. The device as claimed in claim 3, characterized in that the legs (24, 25) are of different lengths.

6. The device as claimed in claim 5, characterized in that the longer leg (24) is provided with the holes (26), which serve for accommodating the pivot pins (13), and assumes an angle of 90° in relation to the yoke (23), while the angle between the shorter leg (25) and the yoke (23) is not more than 100°.

7. The device as claimed in claim 1, characterized in that the carriers (1) are provided, on their top and bottom borders, with in each case one guide for accommodating a section of the coupling element (5).

8. The device as claimed in claim 7, characterized in that the guides prevent movements of the coupling elements (5) parallel to the longitudinal axes of the pivot pins (13).

9. The device as claimed in claim 7, characterized in that the guides form essentially U-shaped guide channels (3, 4) for the coupling elements (5).

10. The device as claimed in claim 9, characterized in that the guide channels (3, 4) are open in the direction of the rear side of the carrier (1).

11. The device as claimed in claim 1, characterized in that the carriers (1) and the coupling elements (5) are provided with latching means which serve for positioning purposes.

12. The device as claimed in claim 11, characterized in that the latching means are formed by latching holes (15) and latching protuberances (27).

13. The device as claimed in claim 1, characterized in that the carrier (1) is designed as a sheet-metal punched part.

14. The device as claimed in claim 13, characterized in that the top and bottom borders of the respective carrier (1) are formed by essentially L-shaped protrusions of the central part (2) of the same.

15. The device as claimed in claim 1, characterized in that a central part (2) of the carrier (1), said central part connecting the top and bottom borders to one another, is provided with guide hollows (19–22), which are arranged in pairs and are intended for accommodating two ends of a support (18) formed from a bent wire.

16. The device as claimed in claim 15, characterized in that, with the support (18) in the fitted state, each of the two ends of the wire forming it rests in four hollows (19–22), which are open alternately toward the front and rear side of the central part (2).

17. The device as claimed in claim 15, characterized in that the distance between the pairs of guide hollows of a carrier (1) is essentially equal to the distance between the adjacent pairs of guide hollows of two carriers (1) which have been coupled together in each case.

18. The device as claimed in claim 2, characterized in that the coupling elements (5) each have two legs (24, 25), which are connected to one another via a yoke (23) and of which one is provided with holes (26), and in that the distance between the legs (24, 25) is greater than the length of the pivot pins (13).

19. The device as claimed in claim 8, characterized in that the guides form essentially U-shaped guide channels (3, 4) for the coupling elements (5).

* * * * *